United States Patent [19]

Ahajot

[11] 3,932,942

[45] Jan. 20, 1976

[54] DRESSMAKER'S PATTERN KIT AND METHOD OF MAKING A GARMENT

[76] Inventor: Kathleen A. Ahajot, 445 S. Los Robles Ave., Pasadena, Calif. 91101

[22] Filed: Jan. 24, 1974

[21] Appl. No.: 436,133

[52] U.S. Cl. ..... 33/12

[51] Int. Cl.[2] ..... A41H 3/06

[58] Field of Search ..... 33/12, 17 R; 112/235

[56] References Cited

UNITED STATES PATENTS

| | | | |
|---|---|---|---|
| 1,630,681 | 5/1927 | Wachter | 33/12 |
| 1,982,005 | 11/1934 | Hutter | 33/12 |
| 2,211,410 | 8/1940 | DuPont | 33/12 |
| 3,511,197 | 5/1970 | Howell | 112/235 |

*Primary Examiner*—Richard E. Aegerter
*Assistant Examiner*—Charles E. Phillips
*Attorney, Agent, or Firm*—Sellers and Brace

[57] ABSTRACT

A dressmaker's pattern kit and method for making a garment of wearing apparel decorated with selected portions of lace and the like decorative material appliqued to the garment before assembly of the garment. The pattern kit includes a pattern sheet imprinted with an image of strip lace or the like decorative material with severance lines clearly marked thereon to guide the seamstress in cutting the lace into individual components. Likewise the pattern components for the garment are imprinted with identified and clearly outlined components of the lace to guide the seamstress in pinning the lace to the garment material preparatory to appliqueing the same in place. Additionally, the kit may include a strip of the uncut lace as well as a set of applique accessories a selected one of which is attachable to a sewing machine in lieu of the usual pressure foot.

9 Claims, 6 Drawing Figures

DRESSMAKER'S PATTERN KIT AND METHOD OF MAKING A GARMENT

This invention relates to dressmaking patterns, and more particularly to an improved pattern kit and to a method of making a designer's "original" garment, such as an original wedding gown.

A garment of wearing apparel designated in dressmaking circles as a designer's original, is characterized primarily by the type and unique arrangement of its decorative components.

These components are cut out from a continuous length of lace yardage and include both those individually appliqued to a garment as well as those used in combination in a selected array involving the artistic talents of the designer. By this technique a selected length of lace can be used advantageously to form a great many distinctive and different designs as well as a variety of different arrangements of these designs on any selected garment pattern.

Prior to this invention there has been no feasible way in which the average seamstress could make a garment of unique design utilizing the artistic talents of a skilled custom designer.

This deficiency in the dressmaking art is surmounted by the present invention which provides a simple inexpensive technique of preparing patterns, instructions and easily followed procedures by which an ordinary seamstress can separate lace yardage into the required number and shape of components, assemble these by pinning in a unique array in particular areas of a garment, and then proceed to applique them to the garment. To this end there is provided by this invention a dressmaker's pattern kit having three specially prepared parts. A first part includes a continuous pattern sheet having the individual pattern components appropriately imprinted thereon to make the most economical use of the material yardage. Preferably the yardage is folded along its longitudinal center line and the pattern sheet is firmly pinned in place thereover with a designated edge of the pattern coinciding with the fold in the yardage. Imprinted on the pattern is an image of all those lace components lying within the confines of the pattern components with each lace image outlined and identified with a distinctive designator.

A second part of the pattern comprises a continuous strip having imprinted thereon an image of the lace yardage and including heavy lines outlining individual lace components as well as identifying designators corresponding to the same designators appearing on the parts of the garment pattern. This second pattern strip is pinned in precise registry beneath the actual lace yardage to guide the seamstress in separating the lace into individual components by severing it along the guide lines provided on the pattern sheet imprinted with the image of the lace. The lace pattern also includes instructions for keeping related components of the lace grouped together until ready for assembly and tacking to the garment components.

The third pattern part comprises one or more pinning guides for the guidance of the seamstress in assembling those decorative arrays of lace which extend across garment seams or project beyond the margin of the garment such as the lace bordering the hem, the collar, the cuffs, etc.

The required amount of lace yardage may be packaged along with the pattern or it may be acquired separately from bulk supplies. The pattern kit also preferably includes one or more special applique accessories attachable to the base end of a sewing machine pressure bar in lieu of the pressure foot accessory commonly used on the machine for normal sewing purposes. The applique pressure foot accessories are specially designed to expedite and facilitate appliqueing the lace to the garment. Each of the applique accessories is designed for attachment to a particular make of sewing machine and all are included as a part of the pattern kit in order that the purchaser, when buying the pattern kit, may be assured that a selected one of the accessories is suitable for use on her sewing machine.

Accordingly, it is a primary object of this invention to provide a unique dressmaker's pattern kit and method usable by the ordinary seamstress in making a designer's original garment of wearing apparel.

Another object of the invention is the provision of a unique method and kit of components utilizing a simple procedure and mode of making garments of wearing apparel decorated with a customized array of lace assembled from a plurality of portions cut from lace yardage and appliqued to selected areas of the garment.

Another object of the invention is the provision of a dressmaker's pattern including a pattern component imprinted with an image of a particular design of lace yardage with different areas thereof outlined and distinctively identified for the guidance of a seamstress in separating the lace into individual components adapted to be assembled and appliqued to garment material in a particular decorative array.

Another object of the invention is the provision of a pinning guide pattern for the guidance of a seamstress in assembling a plurality of lace cutouts for appliqueing to a garment in areas overlying seams or extending beyond marginal edges of the garment.

These and other more specific objects will appear upon reading the following specification and claims and upon considering in connection therewith the attached drawing to which they relate.

Referring now to the drawing in which a preferred embodiment of the invention is illustrated:

Figure 1:
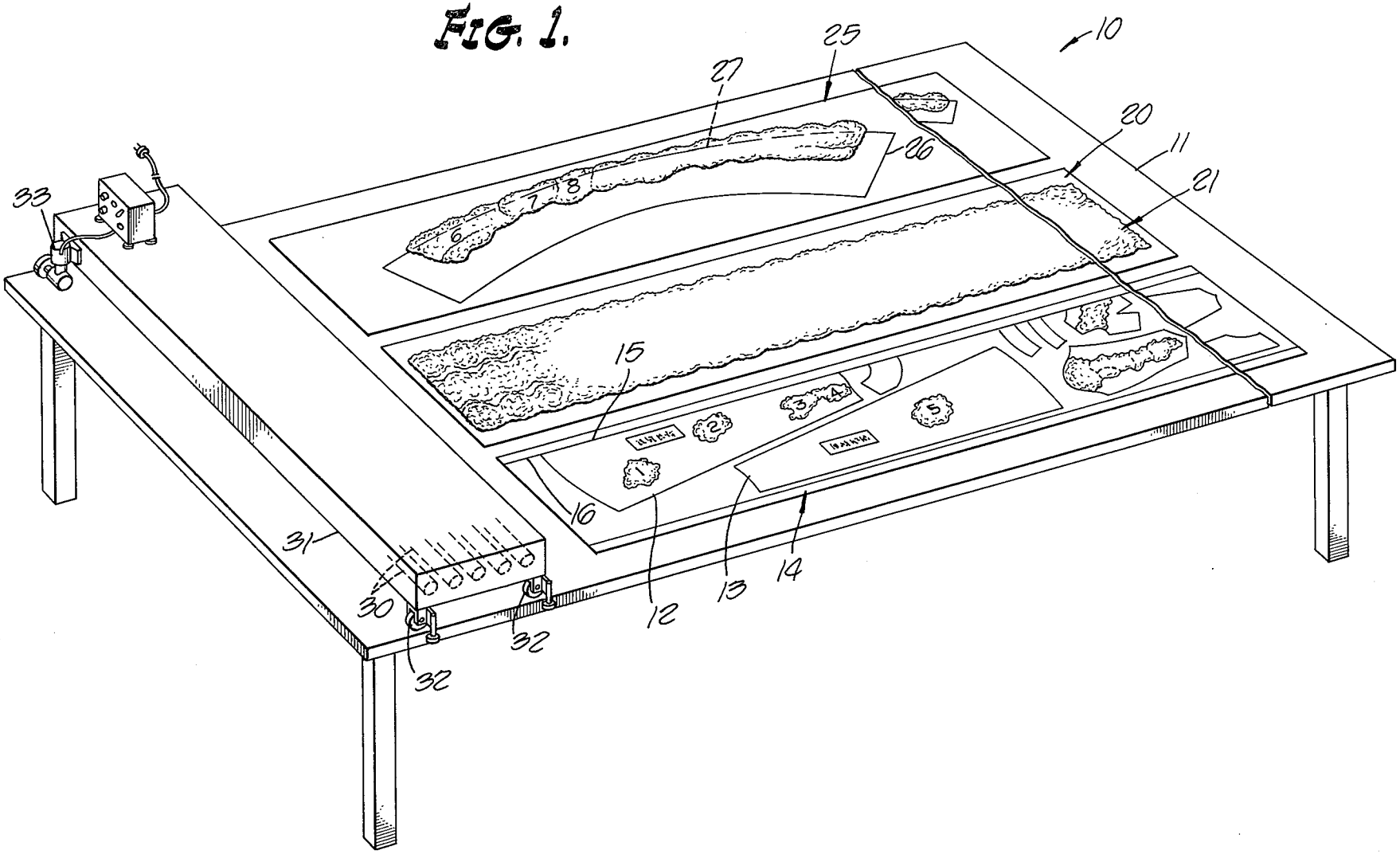
FIG. 1 is a perspective view showing equipment and technique utilized in preparing master prints subsequently utilized in making duplicate portions of the pattern kit in accordance with principles of this invention.

Referring initially more particularly to FIG. 1, there is shown apparatus suitable for use in preparing the master components employed in making duplicate pattern components utilizing the principles of this invention. This apparatus, designated generally 10, comprises a large area table 11. The master copy of the garment pattern is prepared by arranging each element 12, 13 etc. of the pattern on a photosensitive sheet of transparent film material 14, care being exercised to place each of the pattern elements in the best position to make most economical use of the garment material. It will be understood that certain pattern elements, as element 12, represent only half of that particular element, the longitudinal center line 15 of that half being superimposed directly upon the left hand margin line 16 of the master. Another skirt element 13 is generally trapezoidal in shape and the entire portion of that element is shown and will be reproduced on the master when the sensitized material of that strip is exposed to strong light in the manner to be explained presently. It will be understood that each pattern element is placed upon the photosensitive master 14 in the proper position for that element to be cut from the fabric with the warp and weft threads extending in the most advantageous direction for that particular garment component.

At least certain pattern elements include heavy line outlines of each decorative lace component or array along with identifying symbols and other instructive material useful to the dressmaker in identifying and properly locating that lace component or array on the garment before appliqueing it in place thereon. For example, referring to the skirt element 12 in FIG. 1, it will be noted that there are irregular closed loop outlines appearing thereon each marked centrally thereof with the identifying symbols 1, 2, 3, and 4 whereas pattern element 13 bears a single heavy line outline of a decorative component identified as 5. These outlines and the identifying symbols and any other instructions will be reproduced on master 14 and later imprinted upon duplicate pattern parts of the pattern kit. These outlines and symbols are visible through the garment material when flush against the back side thereof and are used by the seamstress as a guide in the proper orientation, location and pinning of the respective lace cutouts to the garment prior to being appliqued thereto.

The middle strip 20 on table 11 is the photosensitive transparent film sheet on which an image of lace yardage 21 is imprinted. Strip 20 corresponds in length with the amount of lace yardage required to decorate the particular garment being made from the garment pattern. Initially, a master is made only of the lace yardage without indicia or division lines between the individual decorative elements to be used in decorating the garment. In completing the master film 20, each lace cutout is outlined in a heavy line closed loop and suitably identified by numbers or symbols corresponding to those within the similarly shaped lace images on the garment pattern. For example, lace elements designated 1 and 2 in the middle strip of FIG. 2 identify the portions of the lace image to be cut from the lace and appliqued to the similarly identified areas of the skirt material.

The third photosensitive sheet 25 is used in preparing a master of each of the "pinning" components and used in making pattern parts to guide the seamstress in assembling those lace arrays which overlap seams or garment edges. In those instances, a master is made of the component or components to which an array of lace is to be appliqued, such as the skirt hemline sector 26, by first superimposing on the photosensitive master 25 an image of the array of lace elements 6, 7, 8, etc. The dotted line 27 underlying the lace represents the marginal edge of the skirt hem and serves as a guide for the seamstress in tacking the array of lace to the hem edge of the skirt material.

After the three masters 14, 20 and 25 have been prepared they are exposed to strong light to imprint an image of the pattern elements and of the lace and other indicia on each of the three masters. This imprinting is accomplished in any suitable manner well known to persons skilled in this art, such as by rolling the bank of strong lamps 30, 30 along the length of table 11. These lamps are supported in an enclosure 31 open only on its underside and supported at its opposite ends on rollers 32. One of rollers 32 comprises a traction roller driven by motor 33. Since the technique for producing master images of the various elements described above is well known and not a part of this invention, it will be unnecessary to describe this equipment in greater detail.

The masters 14, 20 and 25 of the three principal parts of the dressmaker's kit having been processed in the manner described above, any desired number of duplicate pattern copies are made from each by well known duplicating techniques, the prints being made on thin transparent or semi-transparent pattern paper in accordance with customary practice. These three pattern parts are customarily reproduced on separate continuous strips of pattern paper and are shown in FIG. 2 and there identified as pattern kit parts 14', 20' and 25'.

Figure 2:
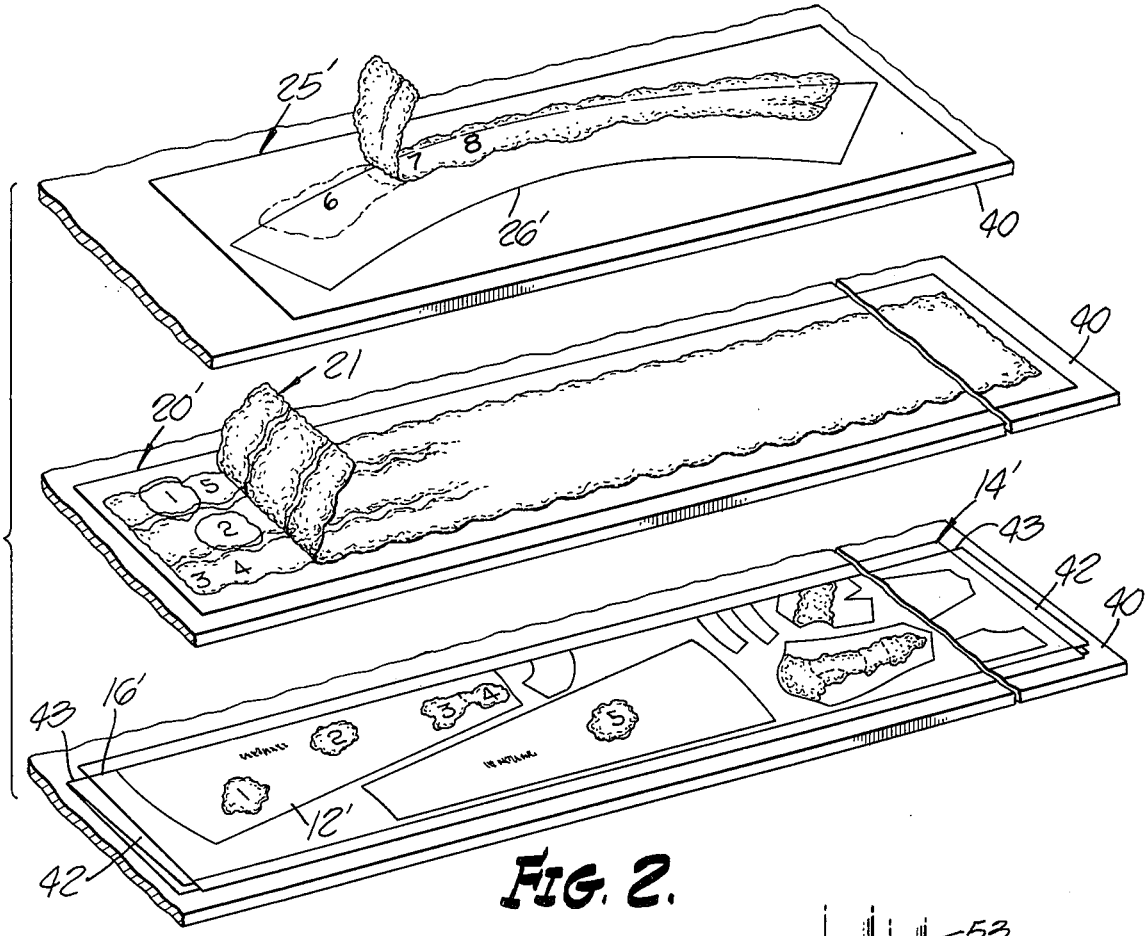
FIG. 2 is a perspective view illustrating the manner in which the seamstress utilizes the three principal parts of the pattern kit.

In proceeding to use the pattern kit, the seamstress folds a continuous strip of the garment material 42 along its longitudinal center line 43 and lays it in smooth out-stretched condition on table 40 as shown in FIG. 2. Pattern part 14' is then unfolded and superimposed on the folded garment material, care being exercised that line 16' along one marginal edge of the pattern is superimposed directly over fold 43 of the material 42. Pattern 14' having been accurately positioned on the material as just described, the seamstress proceeds to pin each component of the pattern to the material at various points to avoid risk of the pattern moving out of position as cutting proceeds and to insure that each pattern part remains attached to the corresponding cutout from material 42. She then cuts each component of the material out along the indicated marginal edges of the pattern until all components have been cut out. The severed parts of the pattern are left attached to the material and laid aside.

The seamstress next proceeds to cut out the individual elements of the decorative lace yardage 21. This is done by first laying the lace pattern 20' on table 40 following which yardage 21 is superimposed thereon in accurate registry with the image on pattern part 20'. These two parts are then pinned together in the same manner described previously following which the seamstress cuts out each element of the lace with the corresponding part of the pattern cutout pinned to it, the heavy outlines of the lace elements being clearly visible through the lace. These cutouts are carefully laid aside in order and with certain of the elements grouped and either pinned together or placed in separate transparent bags or envelopes for convenience in later locating them for assembly.

The garment components are sewn together in the usual way following which the decorative lace elements are pinned or tacked to the garment in the areas represented by an image of that lace element on the first pattern part. For example, when proceeding to assemble the lace elements identified as 1, 2, 3 and 4 on skirt gore 12' (FIG. 2), the seamstress first locates these four lace elements or cutouts and then proceeds to pin them in place in the areas and in the oriented positions identified on the skirt gore in the areas clearly identified on the pattern part 12' for this sector of the skirt. It will be noted that lace elements 1 and 2 are appliqued to spaced apart areas of the garment whereas the elements marked 3 and 4 are appliqued to adjacent areas of the garment to form a typical composite decorative array.

Other areas of the dress or garment are decorated with one or more lace element arrays as, for example, those which extend across seams or portions of which extend beyond the marginal edges of some part of the dress. The elements of these arrays are first assembled by using the pinning guide 25 made from the master 26. Pinning guide 25' is outstretched on the table top following which the individual lace elements 6, 7, 8 etc., used in forming that decorative array are assembled in registry with the correspondingly designated portions of the pinning guide. It will be understood that the individual lace elements have their adjacent marginal edges overlapping for a short distance in order that these overlapped areas can be temporarily pinned together by pins, not shown. It will be noted that the lace elements are assembled and pinned together with one edge of the array projecting beyond the uppermost curved edge of the hemline represented by the arcuate strip 26' on guide 25'. It will be understood that the lace elements are pinned only to one another and not to the pinning guide, the latter being used merely to aid the seamstress in the assembly of the array and in making certain that the elements thereof are assembled correctly to the garment and in the proper sequence. The completed assembly of lace elements is now ready to be placed in the designated place on the face of the garment and to the garment material thereto in readiness for appliqueing.

Figure 4:
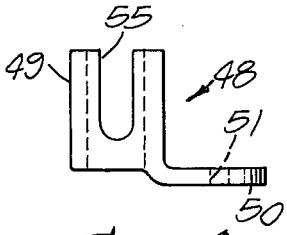
FIGS. 4, 5 and 6 are side elevational views of three different applique pressure foot accessories included in the invention pattern kit and each designed for use on a sewing machine of a different manufacturer.
Figure 3:
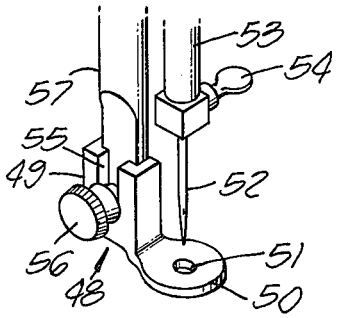
FIG. 3 is a perspective view of a typical sewing machine pressure bar equipped with one of the applique pressure feet.
Figure 5:
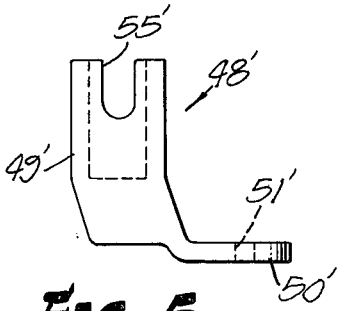
Figure 6:
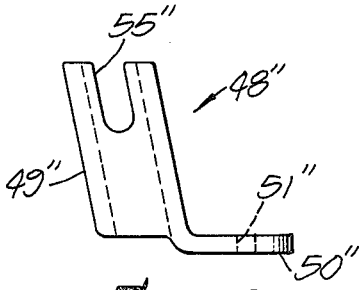

Referring to FIGS. 3–6, there are shown examples of the applique foot accessory each attachable to a sewing machine of particular manufacture in lieu of the customary pressure foot normally used on that machine. FIGS. 3 and 4 show one embodiment of the applique pressure foot whereas FIGS. 5 and 6 show slightly different species for use on the pressure bar of other sewing machines.

Each applique foot is preferably molded in one piece from high-strength transparent plastic material and is characterized by having a minimum surface area in contact with the lace while being appliqued to the garment. The surface in contact with the lace is preferably adjusted to a height above the sewing machine feed dogs such that the feed dogs are rendered generally ineffective to feed the material past the needle but instead leave the material free to be shifted horizontally by the operator past the needle point, in any direction.

Each of the applique pressure accessories 48 has an upright generally tubular mounting shank 49 integral with a small area generally-circular guard pad 50 provided with an aperture 51 having ample clearance with the needle 52. This needle is of course mounted at the lower end of the needle bar 53 and held in place by the thumb nut 54. Shank 49 is provided with a deep slot 55 accommodating the shank of the clamping thumb nut 56 mounted in the lower end of the pressure bar 57. Slot 55 is deep enough to permit insertion of accessory 48 upwardly along the lower end of pressure bar 57 to a level accommodating a relatively thick piece of material and lace to be appliqued thereto while leaving this material free for horizontal movement beneath the accessory. If thinner material is to be appliqued the accessory may be adjusted to an appropriate lower level by loosening thumb nut 56 and then retightening it to anchor the accessory in the desired position.

The accessory shown in FIGS. 5 and 6 is similar in design and purpose to the accessory just described but the mounting shank of each is designed for mounting on the pressure bar of a different style sewing machine.

While the particular dressmaker's pattern kit and method of making a garment herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A by the numbers dressmaker's pattern kit for use in making a garment with customized components of decorative lace appliqued thereto, said kit including:

a garment pattern having imprinted thereon outline guides for cutting garment yardage into individual components of a garment, certain of which outline guides have imprinted thereon irregularly contoured decorative images of at least one lace component of selected size and shape to be appliqued to the face of said garment components, said images each being imprinted with a distinctive identifying symbol;

a decorative lace pattern having imprinted thereon an image of an outstretched unfolded single layer of decorative lace yardage of a selected design and a plurality of closed loop guides superimposed on said lace pattern for subdividing said pattern into areas spaced crosswise and lengthwise thereof and for subdividing said lace yardage into a multiplicity of separate irregularly contoured decorative lace components, each of said closed loop guides being imprinted with an identifying symbol matching a respective symbol of said image of said garment pattern;

wherein said garment pattern outline guides are used to cut out garment components, said plurality of closed loop guides of said decorative lace pattern is used to cut out lace components and said lace components are appliqued to said garment components by using said images of said garment pattern as a guide.

2. A dressmaker's pattern kit as defined in claim 1 further including a pinning guide pattern having imprinted thereon an outline of at least are garment component and including images of a plurality of lace components each imprinted with a distinctive identifying symbol with portions of said lace images extending beyond the edge of the outline of said garment component.

3. A dressmaker's pattern kit as defined in claim 1 characterized in the provision of a substitute foot accessory attachable to a sewing machine pressure bar in lieu of the conventional pressure foot, said substitute foot accessory being so constructed as to permit substantially free movement therebeneath of garment material and said decorative components while being appliqued together.

4. A dressmaker's pattern kit as defined in claim 3 characterized in the provision of a plurality of said foot accessories therein each constructed for use on the pressure bar of a particular design whereby the seamstress may select a foot accessory suited for use with the pressure bar of her sewing machine.

5. A dressmaker's pattern kit as defined in claim 1 characterized in that at least one of the lace images on said garment pattern comprises an array of a plurality of separate lace component images arranged in edge-to-edge relation.

6. A dressmaker's pattern kit for use by a dressmaker in making a customized wedding gown or the like garment decorated with a multiplicity of separate irregularly contoured lace components cut out by the dressmaker from between the opposite lateral edges of a length of lace yardage and appliqued to the exterior of the gown, said kit comprising:

a decorative lace pattern having imprinted thereon an image of an outstretched unfolded single layer of decorative lace yardage of a selected design and a plurality of closed loop guides superimposed on said lace pattern for subdividing said pattern into areas spaced crosswise and lengthwise thereof and for subdividing said lace yardage into a multiplicity of separate irregularly contoured decorative lace components, each of said closed loop guides being imprinted with an identifying symbol;

a pinning guide pattern imprinted with the outline of a garment component and with images of a plurality of selected irregularly contoured areas only of an outstretched length of lace yardage and each of which last mentioned images corresponds to the image of a particular area of the lace image appearing on said lace pattern, said lace images on said pinning guide pattern being arranged in edge-to-edge relation to form at least one array of lace images having an irregularly contoured decorative appearance differing from that in any area of the lace yardage having the same size and shape as said array of lace; and each of the lace images imprinted on said lace pattern being identified by a distinctive symbol corresponding to the same identifying symbol on the similarly shaped lace image on said pinning guide pattern.

7. A dressmaker's pattern kit as defined in claim 6 characterized in the provision of a plurality of transparent plastic bags.

8. A dressmaker's pattern kit as defined in claim 6 characterized in that said images of lace components on said pinning guide pattern have portions thereof extending outwardly beyond the outline of said garment component.

9. A dressmaker's pattern kit as defined in claim 6 characterized in that said pinning pattern is imprinted with a plurality of outlines of different garment components each imprinted with images of decorative lace components at least some of which lace images lie outside the outline of an associated one of said garment components.

* * * * *

UNITED STATES PATENT AND TRADEMARK OFFICE

CERTIFICATE OF CORRECTION

PATENT NO. : 3,932,942

DATED : January 20, 1976

INVENTOR(S) : Kathleen A. Ahajot

It is certified that error appears in the above-identified patent and that said Letters Patent are hereby corrected as shown below:

Please insert Claim 10 as follows:

--10. A by the numbers dressmaker's pattern kit for use in making a garment with customized components of decorative lace appliqued thereto, said kit including: a garment pattern having imprinted thereon one or more closed loop guides, said garment pattern serving to facilitate cutting garment yardage into individual garment components, certain of said closed loop guides being imprinted with an accurately oriented image of the particular lace component to be appliqued to the garment component and including its own distinctive identifying symbol; a decorative lace pattern having imprinted thereon an image of an outstretched unfolded single layer of decorative lace yardage of a selected design along with a plurality of closed loop guides for subdividing the lace yardage in areas spaced crosswise and lengthwise thereof into a multiplicity of separate irregularly contoured decorative lace components, each of said closed loop guides being imprinted with its own distinctive symbol identifying that lace component as the one to be appliqued to the garment in the area identified by the corresponding symbol on said garment pattern; and said garment pattern components being positionable beneath and in registry with the corresponding garment components and with the decorative lace images facing the under surface of the garment thereby to facilitate placing each of said decorative lace components against the outer surface of the garment and in accurate registration with the correspondingly identified one of said lace images as viewed through the garment component preparatory to appliqueing said lace component to the garment component.--

On the cover sheet, after the "Abstract", "9 Claims" should read -- 10 Claims --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*